US011740038B2

(12) United States Patent
Jung et al.

(10) Patent No.: US 11,740,038 B2
(45) Date of Patent: Aug. 29, 2023

(54) FERRITIC STAINLESS STEEL HAVING EXCELLENT SOUND ABSORPTION PROPERTIES FOR EXHAUST SYSTEM HEAT EXCHANGER AND METHOD OF MANUFACTURING THE SAME

(71) Applicant: POSCO, Pohang-si (KR)

(72) Inventors: Il Chan Jung, Pohang-si (KR); Jong Chul Kim, Daegu (KR); Jae Hong Shim, Seoul (KR); Deok Chan Ahn, Seoul (KR); Jin Suk Kim, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 1056 days.

(21) Appl. No.: 16/337,695

(22) PCT Filed: Nov. 22, 2016

(86) PCT No.: PCT/KR2016/013478

§ 371 (c)(1),
(2) Date: Mar. 28, 2019

(87) PCT Pub. No.: WO2018/062618

PCT Pub. Date: Apr. 5, 2018

(65) Prior Publication Data

US 2020/0033077 A1 Jan. 30, 2020

(30) Foreign Application Priority Data

Sep. 28, 2016 (KR) ..... 10-2016-0124985

(51) Int. Cl.

| | |
|---|---|
| ***C22C 38/22*** | (2006.01) |
| ***C22C 38/38*** | (2006.01) |
| ***C22C 38/20*** | (2006.01) |
| ***F28F 21/08*** | (2006.01) |
| ***B22D 11/00*** | (2006.01) |

(Continued)

(52) U.S. Cl.
CPC ..... *F28F 21/083* (2013.01); *B22D 11/002* (2013.01); *C21D 6/002* (2013.01);
(Continued)

(58) Field of Classification Search
CPC ..... C22C 38/04; C22C 38/20; C22C 38/22; C22C 38/38
(Continued)

(56) References Cited

FOREIGN PATENT DOCUMENTS

| | | | |
|---|---|---|---|
| EP | 1484424 | A1 | 12/2004 |
| JP | 2001-1020046 | A | 7/1999 |

(Continued)

OTHER PUBLICATIONS

Yoshihiro et al., JP 2010235995 A machine translation, Oct. 10, 2010, entire translation (Year: 2010).*

(Continued)

*Primary Examiner* — Humera N. Sheikh
*Assistant Examiner* — Katherine A Christy
(74) *Attorney, Agent, or Firm* — Morgan, Lewis & Bockius LLP

(57) ABSTRACT

A ferritic stainless steel for an exhaust system heat exchanger having excellent sound absorption properties and a method for manufacturing the same are disclosed. The ferritic stainless steel for an exhaust system heat exchanger having excellent sound absorption properties includes, by weight percent, 0.001 to 0.01% of C, 0.001 to 0.01% of N, 0.2 to 1% of Si, 0.1 to 2% of Mn, 10 to 30% of Cr, 0.001 to 0.1% of Ti, 0.001 to 0.015% of Al, 0.3 to 0.6% of Nb, 0.01 to 2.5% of Mo, and the balance of Fe and other unavoidable impurities, wherein the number of inclusions existing in a ferrite matrix and satisfying the following Formula 1 is 5 ea/mm$^2$ or more.

3 Claims, 2 Drawing Sheets

(51) Int. Cl.
*C21D 8/02* (2006.01)
*C21D 6/00* (2006.01)
*C22C 38/04* (2006.01)

(52) U.S. Cl.
CPC ..... *C21D 8/0226* (2013.01); *C22C 38/04* (2013.01); *C22C 38/20* (2013.01); *C22C 38/22* (2013.01); *C22C 38/38* (2013.01)

(58) Field of Classification Search
USPC ..... 148/325
See application file for complete search history.

(56) References Cited

FOREIGN PATENT DOCUMENTS

| | | | |
|---|---|---|---|
| JP | 2000-129402 | A | 5/2000 |
| JP | 2000-1443442 | A | 5/2000 |
| JP | 2006-097064 | A | 4/2006 |
| JP | 2010-235995 | A | 10/2010 |
| JP | 2010235995 | A | 10/2010 |
| KR | 10-2011-0074217 | A | 6/2011 |
| KR | 10-2011-0075939 | A | 7/2011 |
| KR | 10-2016-0077515 | A | 7/2016 |
| WO | 2014/157231 | A1 | 10/2014 |

OTHER PUBLICATIONS

International Search Report and Written Opinion dated Jun. 27, 2017 issued in International Patent Application No. PCT/KR2016/013478 (with partial English translation).

Chinese Office Action dated Jul. 21, 2020 issued in Chinese Patent Application No. 201680089643.5 (with English translation).

Extended European Search Report dated Aug. 5, 2019 issued in European Patent Application No. 16917819.1.

* cited by examiner

【FIGURE 1】
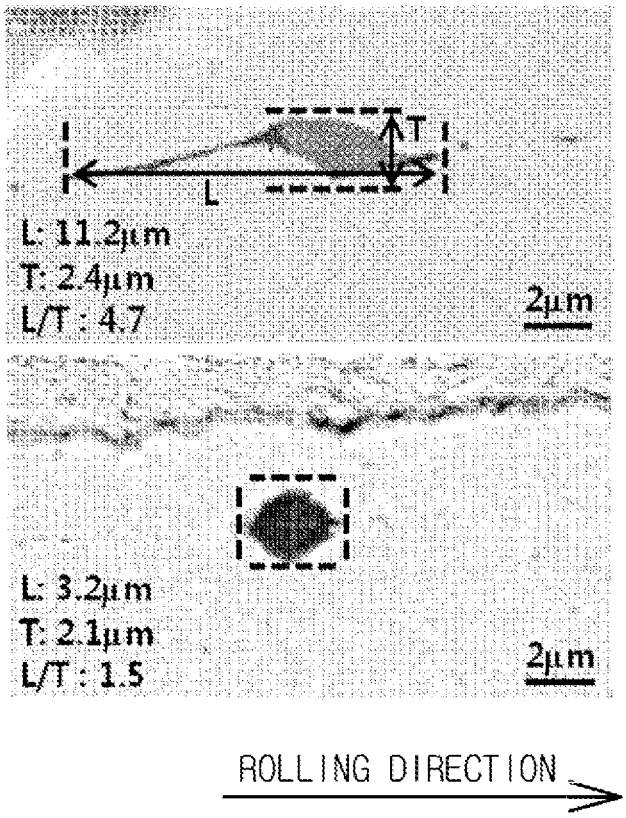

[FIGURE 2]
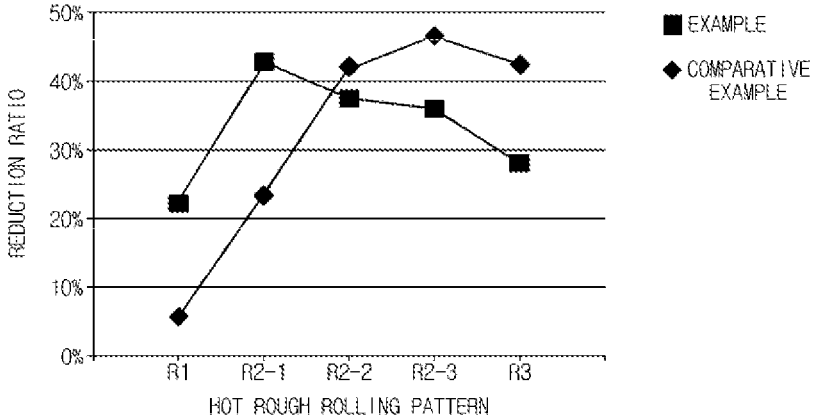
【FIGURE 3】
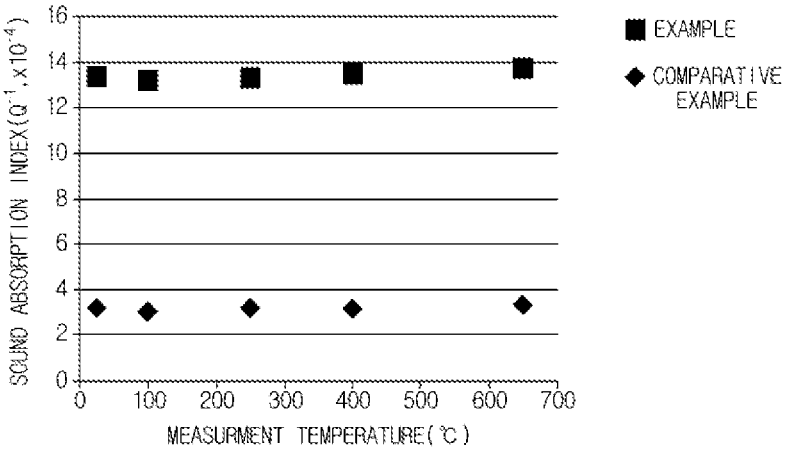

FERRITIC STAINLESS STEEL HAVING EXCELLENT SOUND ABSORPTION PROPERTIES FOR EXHAUST SYSTEM HEAT EXCHANGER AND METHOD OF MANUFACTURING THE SAME

CROSS-REFERENCE OF RELATED APPLICATIONS

This application is the U.S. National Phase under 35 U.S.C. § 371 of International Patent Application No. PCT/KR2016/013478, filed on Nov. 22, 2016, which in turn claims the benefit of Korean Application No. 10-2016-0124985, filed on Sep. 28, 2016, the entire disclosures of which applications are incorporated by reference herein.

TECHNICAL FIELD

The present disclosure relates to ferritic stainless steels for exhaust system heat exchangers and methods of manufacturing the ferritic stainless steels, and more particularly, to ferritic stainless steels for exhaust system heat exchangers with excellent sound absorption properties and methods of manufacturing the same.

BACKGROUND ART

As awareness of environmental concerns has increased in recent years, exhaust gas regulations have become stricter and more stringent limits have been set on carbon dioxide emissions in the field of automobiles. In addition to development of alternative fuels, such as bioethanol and biodiesel, efforts have been made to improve the fuel efficiency by reducing weights of vehicles or installing a heat exchanger for recovery of exhaust heat or to install an exhaust gas treatment system such as an exhaust gas recirculation (EGR) system, a diesel particulate filter (DPF), and a selective catalytic reduction (SCR) system.

Here, the EGR system aims at lowering nitrogen oxide (NOx) which is a harmful gas by lowering combustion temperature and recirculating cooled engine exhaust gas to an intake system, and by increasing heat capacity of a fuel mixer and reducing an amount of oxygen in a combustion chamber. In this EGR system, an EGR cooler is essentially installed so that an exhaust gas and a coolant are exchanged with each other to prevent an excessive temperature rise of the exhaust gas. Here, the EGR cooler is an apparatus for cooling the exhaust gas with an engine coolant or air, and high heat efficiency and thermal conductivity are required for a heat exchanging portion.

Generally, an EGR cooler is installed in a diesel engine. However, in recent years, application of the EGR cooler to a gasoline engine has been studied to achieve both improvement in fuel efficiency and reduction in nitrogen oxides.

Conventionally, austenitic stainless steels such as STS304 and STS316 are generally used for EGR coolers. On the other hand, ferritic stainless steels are superior in corrosion resistance while adding less amounts of expensive alloying elements and tend to be used widely because the ferritic stainless steels are superior in price competitiveness to austenitic stainless steels.

Problems such as a lot of noise and vibration generated in an exhaust system heat exchanger hinder quietness of automobiles and considerably deteriorate durability of parts.

In order to solve these problems, attempts have been made to improve sound absorption by adjusting the number of precipitates and dissolved C and N, and the effect thereof has been reported. However, there is no study on the influence of the type, number, and form of inclusions which are indispensably present in ferritic stainless steel materials on the sound absorbing property, and attempts and achievements to improve sound absorption using inclusions have never been made. (Patent Document 0001) Korean Laid-open Patent Application No. 10-2016-0077515

DISCLOSURE

Technical Problem

Therefore, it is an aspect of the present invention to provide a ferritic stainless steel for an exhaust system heat exchanger having excellent sound absorption properties that may improve quietness and durability when the ferritic stainless steel is used for the exhaust system heat exchanger or the like.

It is another aspect of the present invention to provide a method of manufacturing a ferritic stainless steel for an exhaust system heat exchanger having excellent sound absorption properties.

Technical Solution

In accordance with an aspect of the present disclosure, a ferritic stainless steel for an exhaust system heat exchanger having excellent sound absorption properties includes, by weight percent, 0.001 to 0.01% of carbon C, 0.001 to 0.01% of nitrogen (N), 0.2 to 1% of silicon (Si), 0.1 to 2% of manganese (Mn), 10 to 30% of chromium (Cr), 0.001 to 0.1% of titanium (Ti), 0.001 to 0.015% of aluminum (Al), 0.3 to 0.6% of niobium (Nb), 0.01 to 2.5% of molybdenum (Mo), and the balance of iron (Fe) and other unavoidable impurities, wherein the number of inclusions existing in a ferrite matrix and satisfying the following Formula 1 is 5 ea/mm$^2$ or more:

$$L/T \geq 3 \qquad \text{Formula 1}$$

wherein L is a length of a longer side of each inclusion and T is a length of a shorter side of the inclusion.

The length of the longer side of the inclusion may be greater than 2 μm.

The content of C+N may be 0.018% or less, P may be 0.05% or less, and S may be 0.005% or less.

The ferritic stainless steel may further include 0.01 to 0.15% of copper (Cu), 0.0002 to 0.001% of magnesium (Mg), and 0.0004 to 0.002% of calcium (Ca).

The ferritic stainless steel may satisfy the following Formula 2.

$$Si/(Al+0.1*Ti) \geq 15 \qquad \text{Formula 2}$$

A composition of the inclusion may satisfy the following Formulae 3 and 4.

$$\%\ (Al_2O_3)+\%\ (MgO)+\%\ (SiO_2)+\%\ (CaO)>90\% \qquad \text{Formula 3\%}$$

$$\%\ (Al_2O_3)+\%\ (MgO)<50\% \qquad \text{Formula 4}$$

A sound absorption index of the stainless steel may be $7.0*10^{-4}$ or more.

In accordance with another aspect of the present disclosure, a method of manufacturing the ferritic stainless steel for an exhaust system heat exchanger having excellent sound absorption properties includes: hot rolling a ferritic stainless steel slab including, by weight percent, 0.001 to 0.01% of carbon (C), 0.001 to 0.01% of nitrogen (N), 0.2 to 1% of silicon (Si), 0.1 to 2% of manganese (Mn), 10 to 30% of chromium (Cr), 0.001 to 0.1% of titanium (Ti), 0.001 to 0.015% of aluminum (Al), 0.3 to 0.6% of niobium (Nb), 0.01 to 2.5% of molybdenum (Mo), and the balance of iron (Fe) and other unavoidable impurities, wherein in the hot rolling, at least one of the initial two passes of rough rolling is subjected to strong rolling a front end with a reduction ratio of 40% or more.

The rough rolling process includes steps R1 to R3, wherein the reduction ratios of the initial two passes of R1 and R2-1 may be gradually increased, and the reduction ratios for the last three passes of R2-2, R2-3 and R3 may be gradually reduced.

In the R1 step, rolling may be performed at a reduction ratio of 20% or more, and wherein in the R2-1 step, rolling may be performed at a reduction ratio of 40% or more.

In the R2-2, R2-3, R3 steps, rolling may be performed at a reduction ratio of less than 40%.

The ferritic stainless steel slab is produced by continuously casting a molten steel, and a basicity ($CaO/SiO_2$) of the molten steel may be from 0.9 to 1.1.

A composition of the inclusion in the molten steel may satisfy the following Formulae 3 and 4.

$$\%(Al_2O_3)+\%(MgO)+\%(SiO_2)+\%(CaO)>90\% \quad \text{Formula 3\%}$$

$$\%(Al_2O_3)+\%(MgO)<50\% \quad \text{Formula 4}$$

Advantageous Effects

According to the embodiments of the present disclosure, the type, number and form of inclusions included in the ferritic stainless steel may be controlled by controlling the alloy components and the manufacturing process of the ferritic stainless steels. Accordingly, when the ferritic stainless steel is used for an exhaust system heat exchanger or the like, excellent sound absorption properties may be obtained, and quietness and durability of the exhaust system heat exchanger may be improved.

DESCRIPTION OF DRAWINGS

These and/or other aspects of the disclosure will become apparent and more readily appreciated from the following description of the embodiments, taken in conjunction with the accompanying drawings of which:

FIG. 1 is a scanning electron microscope (SEM) image of a cold-rolled annealed ferritic stainless steel sheet according to an embodiment of the present disclosure;

FIG. 2 is a graph for explaining a method of manufacturing a ferritic stainless steel according to an embodiment of the present disclosure; and FIG. 3 is a graph for explaining sound absorption performance of a ferritic stainless steel according to an embodiment of the present disclosure.

MODES OF THE INVENTION

According to an embodiment of the present disclosure, there is provided a ferritic stainless steel for an exhaust system heat exchanger having excellent sound absorption including, by weight percent, 0.001 to 0.01% of carbon (C), 0.001 to 0.01% of nitrogen (N), 0.2 to 1% of silicon (Si), 0.1 to 2% of manganese (Mn), 10 to 30% of chromium (Cr), 0.001 to 0.1% of titanium (Ti), 0.001 to 0.015% of aluminum (Al), 0.3 to 0.6% of niobium (Nb), 0.01 to 2.5% of molybdenum (Mo), and the balance of iron (Fe) and other unavoidable impurities, wherein the number of inclusions existing in a ferrite matrix and satisfying the following Formula 1 is 5 ea/mm$^2$ or more:

$$L/T \geq 3 \quad \text{Formula 1}$$

wherein L is a length of a longer side of each inclusion and T is a length of a shorter side of the inclusion.

Modes of the Invention

Hereinafter, the embodiments of the present disclosure will be described in detail with reference to the accompanying drawings. The following embodiments are provided to transfer the technical concepts of the present disclosure to one of ordinary skill in the art. However, the present disclosure is not limited to these embodiments, and may be embodied in another form. In the drawings, parts that are irrelevant to the descriptions may be not shown in order to clarify the present disclosure, and also, for easy understanding, the sizes of components are more or less exaggeratedly shown.

The inventors of the present disclosure have made various studies to improve sound-absorbing properties of ferritic stainless steel material when used for exhaust system heat exchangers, and the following findings may be obtained.

Generally, in carbon steels, dissolved C and N fluctuate in lattices causing energy loss during vibration, as a result, sound absorption is obtained.

However, since movement of C and N is temperature-sensitive, C and N absorb sound only in a narrow temperature range and have poor corrosion resistance. On the other hand, high Cr steels have excellent corrosion resistance, and the sound absorption effect thereof is also excellent due to internal movement of C and N. This is because energy is lost due to movement of magnetic domain walls in grains, thereby improving the sound absorption effect.

Generally, a small amount of Nb is added to a ferritic stainless steel for an exhaust system heat exchanger in order to improve high temperature strength. In the case of Nb-added ferritic stainless steels, a large amount of Nb(N, C) precipitates in a ferrite matrix of a surface layer. Such Nb(N, C) precipitates pinning movement of the magnetic domain walls, which is one of the sound absorbing mechanisms during vibration, essentially weaken the sound absorption property of the ferritic stainless steel. Also, since C and N are mostly bonded to Nb and Ti in a precipitate state, there is almost no dissolved C and N in the ferrite matrix, as a result, the sound absorption mechanism (Snoek effect) obtained by the movement of the dissolved C and N during vibration cannot be expected.

On the other hand, ferritic stainless steels include inevitable inclusions. When vibration occurs from the outside, an interface between the inclusion and the ferrite matrix is vibrated, so that the external vibration can be canceled. In this case, as the number of inclusions having a relatively long length ratio between the longer side and the shorter side of the inclusions (longer side length/shorter side length) increases, the total area of the interface between the inclusions and the ferrite matrix (Interphase surface area) is increased, thereby improving the sound absorption property.

In order to form inclusions having a long length ratio between the longer side and the shorter side, the composition characteristics of the inclusions must be easily deformable in a hot rolling temperature range. In addition, when the reduction ratio of the rough rolling front end having the highest temperature during the hot rolling process is high, stretching of the inclusions can be facilitated, so that the area of the interface between the inclusions and the ferrite matrix increases, and the sound absorption property may be improved.

Hereinafter, the components and inclusions of the ferritic stainless steel for an exhaust system heat exchanger having excellent sound absorption properties according to an embodiment of the present disclosure will be described in detail.

According to an embodiment of the present disclosure, there is provided a ferritic stainless steel for an exhaust system heat exchanger having excellent sound absorption including, by weight percent, 0.001 to 0.01% of carbon (C), 0.001 to 0.01% of nitrogen (N), 0.2 to 1% of silicon (Si), 0.1 to 2% of manganese (Mn), 10 to 30% of chromium (Cr), 0.001 to 0.1% of titanium (Ti), 0.001 to 0.015% of aluminum (Al), 0.3 to 0.6% of niobium (Nb), 0.01 to 2.5% of molybdenum (Mo), and the balance of iron (Fe) and other unavoidable impurities.

C: 0.001 to 0.01%

Carbon is an element that greatly affects strength of steels. When the C content is excessive, strength of a steel is excessively increased to deteriorate ductility, so that an upper limit thereof may be 0.01% or less. However, when the C content is too low, the strength is excessively lowered, so that a lower limit may be 0.001%.

N: 0.001 to 0.01%

Nitrogen is an element which accelerates recrystallization by precipitation of austenite during hot rolling. In the present disclosure, 0.001% or more of nitrogen is added. However, when the N content is excessive, ductility of the steel is deteriorated, and the N content is limited to 0.01% or less.

Si: 0.2 to 1.0%

Silicon is an element added for deoxidation of a molten steel during steelmaking and stabilization of ferrite. In the present disclosure, silicon is added by 0.2% or more. However, when the Si content is excessive, the material is hardened and ductility of the steel is lowered, and the Si content is limited to 1.0% or less.

Mn: 0.1 to 2%

Manganese is an element effective for improving corrosion resistance. In the present disclosure, 0.1% or more, and more preferably 0.5% or more of manganese is added. However, when the Mn content is excessive, occurrence of Mn-based fumes is increased so that weldability is deteriorated and ductility of the steel is deteriorated due to formation of excessive MnS precipitates. The Mn content is limited to 2.0% or less, more preferably 1.5%.

Cr: 10 to 30%

Chromium is an element effective for improving corrosion resistance of steels. In the present disclosure, Cr is added by 10% or more. However, when the Cr content is excessive, not only manufacturing costs increase but also grain boundary corrosion occurs, so that the Cr content is limited to 30% or less.

Ti: 0.001% to 0.1%

Titanium fixes carbon and nitrogen to reduce amounts of dissolved carbon and dissolved nitrogen in steels and is effective in improving corrosion resistance of the steels. However, there is a disadvantage that exposure to high temperature environment causes discoloration. Therefore, the content of Titanium may be limited to 0.1% or less. However, the Ti component in a molten steel exists as an inevitable impurity. Since the manufacturing cost is increased to completely remove Ti to 0%, 0.001% or more is allowed.

Al: 0.001% to 0.015%

Aluminum is a strong deoxidizing agent and serves to lower the content of oxygen in a molten steel. In the present disclosure, Al is added in an amount of 0.001% or more. However, when the Al content is excessive, sleeve defects of the cold-rolled strip occur due to the increase of nonmetallic inclusions, and weldability deteriorates, so that the Al content is limited to 0.015% or less.

Nb: 0.3% to 0.6%

Niobium precipitates in combination with carbon to form NbC, thereby lowering an amount of dissolved carbon and increasing corrosion resistance and increasing strength at high temperature. Therefore, in the present disclosure, it is preferable to add at least 0.3% of Nb. However, when the Nb content thereof is excessive, recrystallization is inhibited and formability is lowered. Thus, the Nb content may be 0.6% or less.

Mo: 0.01 to 2.5%

Molybdenum enhances corrosion resistance of ferritic stainless steels and improves high temperature strength. Therefore, it is preferable to add Mo by 0.01% or more. However, when the Mo content is excessive, brittleness occurs due to generation of intermetallic precipitates. Therefore, the Mo content may be 2.5% or less.

For example, according to an embodiment of the present disclosure, the content of C+N may be 0.018% or less, P may be 0.05% or less, and S may be 0.005% or less.

C+N: 0.018% or less

When the content of carbon and nitrogen is excessive, strength of the steel is excessively increased and ductility is lowered. Therefore, the upper limit of a sum thereof may be 0.018% or less.

P: 0.05% or less

Phosphorus is an impurity inevitably contained in steels, and is an element that causes intergranular corrosion at the time of pickling or deteriorates hot workability. Therefore, it is preferable to control the P content as low as possible. In the present disclosure, the upper limit of the content of phosphorus is controlled to 0.05%.

S: 0.005% or less

Sulfur is an impurity inevitably contained in steels, it is an element that is segregated in grain boundaries and is a main cause of hindering hot workability. Therefore, it is desirable to control the content as low as possible. In the present disclosure, the upper limit of the sulfur content is controlled to 0.005%.

For example, according to an embodiment of the present disclosure, it may further include 0.01 to 0.15% of Cu, 0.0002 to 0.001% of Mg, and 0.0004 to 0.002% of Ca.

Cu: 0.01% to 0.15%

Copper has the effect of increasing corrosion resistance in an exhaust system condensate environment. Therefore, it is preferable to add Cu by 0.01% or more. However, when the Cu content is excessive, ductility is lowered and the quality of formation is lowered. Therefore, it is preferable to limit the Cu content to 0.15% or less.

Mg: 0.0002 to 0.001%

Magnesium is an element added for deoxidation in a steelmaking process and remains as an impurity after a deoxidation process. However, when the Mg content is excessive, formability is poor, so the Mg content is limited to 0.001% or less. It is impossible to completely remove Mg, so it is preferable to manage the Mg content to 0.0002% or more.

Ca: 0.0004 to 0.002%

Calcium is an element added for deoxidation in a steelmaking process and remains as an impurity after a deoxidation process. However, when the Ca content is excessive, corrosion resistance is lowered, so that the Ca content is limited to 0.002% or less. It is impossible to completely remove Ca, so it is preferable to manage the Ca content to 0.0004% or more.

FIG. 1 is a scanning electron microscope (SEM) image of a cold-rolled annealed ferritic stainless steel sheet according to an embodiment of the present disclosure.

In the ferritic stainless steel for an exhaust system heat exchanger having excellent sound absorption according to an embodiment of the present disclosure, the number of inclusions existing in the ferrite matrix and satisfying the following Formula 1 is 5 ea/mm$^2$ or more.

$$L/T \geq 3 \quad \text{Formula 1}$$

In Formula 1, L is a length of a longer side of each inclusion and T is a length of a shorter side of the inclusion.

For example, according to an embodiment of the present disclosure, the length of the longer side of the inclusion may be greater than 2 μm.

As described above, ferritic stainless steels include inevitable inclusions. In this case, when the number of inclusions having a relatively long length ratio between the longer side and the shorter side of the inclusions (longer side length/shorter side length) is large, the sound absorption property is improved.

For example, inclusions satisfying the above Formula 1 may be defined as effective inclusions, and when the number of such an effective inclusion is 5 ea/mm$^2$ or more, the inclusions may effectively work to improve sound absorption.

According to an embodiment of the present disclosure, the ferritic stainless steel may satisfy the following Formula 2.

$$Si/(Al+0.1*Ti) \geq 15 \quad \text{Formula 2}$$

The composition of the inclusions present in the ferrite matrix of the ferritic stainless steel is sensitive to the composition of the steel itself preferentially.

When the above Formula 2 is satisfied, a composition of inclusions according to one embodiment of the present disclosure may be obtained. When the inclusions have such a composition, the inclusions may be stretched in a rolling direction during hot rolling, satisfying the above Formula 1. The composition of the inclusions will be described later in detail.

For example, according to an embodiment of the present disclosure, the composition of the inclusions may satisfy the following Formulae 3 and 4.

$$\%\ (Al_2O_3)+\%\ (MgO)+\%\ (SiO_2)+\%\ (CaO)>90\% \quad \text{Formula 3\%}$$

$$\%\ (Al_2O_3)+\%\ (MgO)<50\% \quad \text{Formula 4}$$

When the inclusions satisfy the above-mentioned Formulae 3 and 4, the inclusions may be stretched in the rolling direction during the hot rolling. On the other hand, when the composition of the inclusions does not satisfy the Formula 3 or Formula 4, the inclusions cannot be stretched at a hot rolling temperature range of 800 to 1,300° C., and thus only the inclusions having a longer side length/shorter side length ratio of about 1 exist even after hot rolling.

Therefore, the sound absorption index of the ferritic stainless steel for an exhaust system heat exchanger excellent in sound absorption according to an embodiment of the present disclosure may be $7.0*10^{-4}$ or more. Therefore, when the ferritic stainless steel is used for an exhaust system heat exchanger or the like, superior sound absorption properties may be obtained, and thus quietness and durability of the exhaust system heat exchanger may be improved.

FIG. 2 is a graph for explaining a method of manufacturing a ferritic stainless steel according to an embodiment of the present disclosure.

Referring to FIG. 2, a method of manufacturing a ferritic stainless steel for an exhaust system heat exchanger having excellent sound absorption properties according to an embodiment of the present disclosure includes: hot rolling a ferritic stainless steel slab including, by weight percent, 0.001 to 0.01% of carbon (C), 0.001 to 0.01% of nitrogen (N), 0.2 to 1% of silicon (Si), 0.1 to 2% of manganese (Mn), 10 to 30% of chromium (Cr), 0.001 to 0.1% of titanium (Ti), 0.001 to 0.015% of aluminum (Al), 0.3 to 0.6% of niobium (Nb), 0.01 to 2.5% of molybdenum (Mo), and the balance of iron (Fe) and other unavoidable impurities, wherein in the hot rolling, at least one of initial two passes of rough rolling is subjected to strong rolling at a front end with a reduction ratio of 40% or more.

In order to form inclusions having a long length ratio between the longer side and the shorter side, compositional characteristics of the inclusions need to be easily changeable in the hot rolling temperature range. Further, in a rough rolling step of the hot rolling process having the highest temperature, a reduction ratio of the front end need to be high to facilitate stretching of the inclusions, thereby increasing an interfacial area between the inclusions and the ferrite matrix, and improving the sound absorption property.

Generally, a hot rolling process is divided into a heating step for heating a slab, a rough rolling step for controlling thickness and width of the heated slab, a finishing rolling step for final control to obtain a target size of the product after rough rolling, a water-cooling step for homogenizing the material of the strip after finishing rolling, and a winding step for winding the rolled strip into a hot-rolled coil.

A rough rolling pass pattern of a ferritic stainless steel for an exhaust system heat exchanger excellent in sound absorption properties according to an embodiment of the present disclosure includes five rolling processes of R1, R2-1, R2-2, R2-3 and R3 in total. However, temperature decreases as the slab is closer to the rear end of a rough rolling apparatus since the time elapsed after the slab is extracted from a heating furnace and the effect of the roll coolant is added thereto. There is a problem that the inclusions are not easily stretched as temperature is reduced.

For example, the rough rolling process includes steps R1 to R3, wherein the reduction ratios for initial two passes of R1 and R2-1 may be gradually increased, and the reduction ratios for last three passes of R2-2, R2-3 and R3 may be gradually reduced.

Herein, the steps R1 and R2-1 are stages of the preliminary rolling stage in which the temperature of the slab is not significantly lowered after the slab is extracted from the heating furnace. In this step, the inclusions are more easily stretched than those rolled at the end thereof after rough rolling, and inclusive material satisfying the Formula 1 can be obtained.

For example, the slab may be rolled at a reduction ratio of 20% or more in the R1 step, and may be rolled at a reduction ratio of 40% or more in the R2-1 step. Thereafter, the slab may be rolled at a reduction ratio of less than 40% in steps R2-2, R2-3 and R3.

For example, the composition of the inclusions in the molten steel may satisfy the following Formulae 3 and 4.

$$\%\ (Al_2O_3)+\%\ (MgO)+\%\ (SiO_2)+\%\ (CaO)>90\% \quad \text{Formula 3\%}$$

$$\%\ (Al_2O_3)+\%\ (MgO)<50\% \quad \text{Formula 4}$$

For example, the molten steel may satisfy the Formula 2. Further, for example, the ferritic stainless steel slab is produced by continuously casting the molten steel, and a basicity ($CaO/SiO_2$) of the molten steel may be 0.9 to 1.1.

By controlling the composition and the basicity of the molten steel, the composition of the inclusions satisfying the above-mentioned Formulae 3 and 4 may be achieved.

When the inclusions satisfy the above-mentioned Formulae 3 and 4, the inclusions may be stretched in the rolling direction in the hot rolling. On the other hand, when the composition of the inclusions does not satisfy the Formula 3 or the Formula 4, stretching is impossible in the hot rolling temperature range of 800 to 1,300° C., only the inclusions having a longer side length/shorter side length ratio of about 1 exist even after hot rolling.

Hereinafter, a ferritic stainless steel for an exhaust system heat exchanger having excellent sound absorption properties according to an embodiment of the present disclosure will be described in detail through Examples.

EXAMPLES

Molten steels having the compositions shown in Table 1 were prepared and slabs were produced using the molten steels through continuous casting.

TABLE 1

| Wt. % | C | N | Si | Mn | P | S | Cr | Ti | Al | Nb | Mo |
|---|---|---|---|---|---|---|---|---|---|---|---|
| Inventive steel 1 | 0.007 | 0.009 | 0.35 | 0.83 | 0.031 | 0.04 | 18.6 | 0.08 | 0.015 | 0.52 | 2.2 |
| Inventive steel 2 | 0.009 | 0.008 | 0.31 | 0.84 | 0.032 | 0.003 | 18.7 | 0.02 | 0.01 | 0.54 | 2 |
| Comparative steel 1 | 0.011 | 0.009 | 0.25 | 0.87 | 0.031 | 0.003 | 18.5 | 0.2 | 0.12 | 0.53 | 2.1 |
| Comparative steel 2 | 0.008 | 0.01 | 0.29 | 0.85 | 0.028 | 0.004 | 18.4 | 0.09 | 0.02 | 0.51 | 1.9 |

The slabs were reheated to 1,300° C., and hot rough rolling was performed in accordance with the hot rough rolling pattern of FIG. 2 respectively. Subsequently, cold rolling and annealing were performed to obtain cold-rolled and annealed sheets having a thickness of 1 mm.

Examples 1 and 2 and Comparative Examples 3 and 4 respectively show the Inventive steels 1 and 2, and Comparative steels 1 and 2 rolled according to the rough rolling pattern of the present disclosure. And Comparative examples 1, 2, 5 and 6 respectively show the Inventive steels 1 and 2, and Comparative steels 1 and 2 rolled according to a conventional rough rolling pattern.

That is, according to the rough rolling pattern of the present disclosure, the steel sheet was rolled at a reduction ratio of 22% in R1, 42% in R2-1, 38% in R2-2, 36% in R2-3, and 29% in R3 to roll the front end strongly.

On the contrary, according to the conventional rough rolling pattern, the steel sheet was rolled at a reduction ratio of 5% in R1, 23% in R2-1, 42% in R2-2, 47% in R2-3, and 42% in R3.

TABLE 2

| | Steel type | Si/(Al + 0.1Ti) | $Al_2O_3$ + MgO | $Al_2O_3$ + MgO + $SiO_2$ + CaO | basicity (CaO/$SiO_2$) |
|---|---|---|---|---|---|
| Example 1 | Inventive steel 1 | 15.2 | 48 | 95 | 0.98 |
| Example 2 | Inventive steel 2 | 25.8 | 39 | 94 | 1.08 |
| Comparative Example 1 | Inventive steel 1 | 15.2 | 48 | 95 | 0.98 |
| Comparative Example 2 | Inventive steel 2 | 25.8 | 39 | 94 | 1.08 |

TABLE 2-continued

| | Steel type | Si/(Al + 0.1Ti) | $Al_2O_3$ + MgO | $Al_2O_3$ + MgO + $SiO_2$ + CaO | basicity (CaO/$SiO_2$) |
|---|---|---|---|---|---|
| Comparative Example 3 | Comparative steel 1 | 1.8 | 80 | 91 | 0.92 |
| Comparative Example 4 | Comparative steel 2 | 10 | 73 | 93 | 1.05 |
| Comparative Example 5 | Comparative steel 1 | 1.8 | 80 | 91 | 0.92 |
| Comparative Example 6 | Comparative steel 2 | 10 | 73 | 93 | 1.05 |

The cold-rolled and annealed sheet having a thickness of 1 mm was photographed with a Scanning Electron Microscope (SEM) and the composition of the inclusions was analyzed through an element analysis (EDS) and an image analyzer. The form of the inclusions was analyzed and shown in Table 2 above.

TABLE 3

| | Steel type | Effective inclusions (ea) | $Q^{-1}$ (@25° C.) | $Q^{-1}$ (@650° C.) | rough rolling pattern |
|---|---|---|---|---|---|
| Example 1 | Inventive steel 1 | 5.5 | 9.2 | 9.3 | roll the front end strongly |
| Example 2 | Inventive steel 2 | 8.5 | 13.4 | 13.7 | roll the front end strongly |
| Comparative Example 1 | Inventive steel 1 | 3.8 | 5.7 | 5.5 | conventional |
| Comparative Example 2 | Inventive steel 2 | 4.5 | 6.7 | 6.8 | conventional |
| Comparative Example 3 | Comparative steel 1 | 1.6 | 3.6 | 3.8 | roll the front end strongly |
| Comparative Example 4 | Comparative steel 2 | 3.9 | 5.9 | 5.8 | roll the front end strongly |
| Comparative Example 5 | Comparative steel 1 | 1.3 | 3.5 | 3.4 | conventional |
| Comparative Example 6 | Comparative steel 2 | 2.7 | 4.5 | 4.7 | conventional |

The effective inclusions in Table 2 refer to inclusions existing in the ferrite matrix and satisfying the following Formula 1.

$$L/T \geq 3 \qquad \text{Formula 1}$$

In Formula 1, L is the length of the longer side of the inclusion and T is the length of the shorter side of the inclusion (The longer side length of the inclusions exceeds 2 μm).

FIG. 3 is a graph for explaining sound absorption performance of a ferritic stainless steel according to an embodiment of the present disclosure.

Sound absorption property was measured by IMCE's "RFDA LTVP800" equipment. The above equipment applies a constant impact to a sample of 80 mm (length)*20 mm (width)*1 mm (thickness) to generate vibration with a natural frequency, and then measures the degree of sound attenuation to obtain a sound absorption index. The higher the sound absorption index, the faster the sound attenuation. The above equipment may obtain the sound absorption index for a temperature range of 25° C. to 650° C.

Referring to FIG. 3, it is possible to confirm the sound absorption index over the entire temperature range. The sound absorption index (Q-1, $*10^{-4}$) for each of the final heat-treated alloys was obtained at room temperature (25° C.) and a high temperature (650° C.) and shown in Table 3 above.

Referring to Tables 2 and 3, in the case of Examples 1 and 2 satisfying the conditions proposed by the present disclosure, the number of effective inclusions was 5 ea or more per 1 $mm^2$, and the sound absorption index (Q-1) was $7.0\times10^{-4}$ or higher at room temperature and a high temperature, which is the main use environment of the exhaust system heat exchanger. It was possible to obtain the sound absorption property twice as high as that of the conventional steels.

On the other hand, the comparative examples showed insufficient sound absorption property since the number of effective inclusions was less than 5 ea per 1 $mm^2$.

Referring to FIG. 1, an upper image is a photograph of the inclusions formed on the cold-rolled annealed sheet according to Example 1, and a lower image is a photograph of the inclusions formed on the cold-rolled annealed sheet according to Comparative Example 5. The shapes of the inclusions effective and ineffective for sound absorption may be visually confirmed referring to FIG. 1.

While the present disclosure has been particularly described with reference to exemplary embodiments, it should be understood by those of skilled in the art that various changes in form and details may be made without departing from the spirit and scope of the present disclosure.

INDUSTRIAL APPLICABILITY

The ferritic stainless steel for an exhaust system heat exchanger having excellent sound absorption properties and the manufacturing method thereof according to the embodiments of the present disclosure can be applied to an exhaust system heat exchanger such as an EGR cooler.

The invention claimed is:

1. A ferritic stainless steel for an exhaust system heat exchanger, the ferritic stainless steel comprising, by weight percent, 0.001 to 0.01% of carbon (C), 0.001 to 0.01% of nitrogen (N), 0.2 to 1% of silicon (Si), 0.1 to 2% of manganese (Mn), 10 to 30% of chromium (Cr), 0.001 to 0.1% of titanium (Ti), 0.001 to 0.015% of aluminum (Al), 0.51 to 0.60% of niobium (Nb), 0.01 to 2.5% of molybdenum (Mo), and the balance of iron (Fe) and other unavoidable impurities, further comprising any one or more 0.01 to 0.15% of copper (Cu), 0.0002 to 0.001% of magnesium (Mg), and 0.0004 to 0.002% of calcium (Ca), wherein the number of inclusions existing in a ferrite matrix in which a length of a longer side is greater than 2 μm and satisfying Formula 1 is 5 ea/$mm^2$ or more, and the inclusions comprise two or more of $Al_2O_3$, MgO, $SiO_2$ and CaO:

$$L/T \geq 3 \quad \text{Formula 1}$$

wherein L is the length of the longer side of each inclusion and T is a length of a shorter side of the inclusion;

wherein a composition of the inclusions satisfies Formulae 3 and 4:

$$\%\ (Al_2O_3)+\%\ (MgO)+\%\ (SiO_2)+\%\ (CaO)>90\% \quad \text{Formula 3\%}$$

$$(Al_2O_3)+\%\ (MgO)<50\% \quad \text{Formula 4}$$

wherein % ($Al_2O_3$), % (MgO), % ($SiO_2$) and % (CaO) mean the content (% by weight) of each inclusion;

wherein a sound absorption index of the ferritic stainless steel is $7.0*10^{-4}$ or more.

2. The ferritic stainless steel according to claim 1, wherein the ferritic stainless steel comprises 0.018% or less of C+N, 0.05% or less of P, and 0.005% or less of S.

3. The ferritic stainless steel according to claim 1, wherein the ferritic stainless steel satisfies Formula 2:

$$Si/(Al+0.1*Ti)\geq 15 \quad \text{Formula 2}$$

wherein Si, Al and Ti mean the content (% by weight) of each element.

* * * * *